US006267231B1

(12) United States Patent
Burns

(10) Patent No.: US 6,267,231 B1
(45) Date of Patent: Jul. 31, 2001

(54) COTTON SWAB STORAGE UNIT HAVING AUTOMATIC SWAB EXTRACTION AND RETENTION STRUCTURE AND METHOD OF MANUFACTURE THEREOF

(76) Inventor: Arthur Dale Burns, 6609 Shadow Crest, Plano, TX (US) 75093

( * ) Notice: Subject to any disclaimer, the term of this patent is extended or adjusted under 35 U.S.C. 154(b) by 0 days.

(21) Appl. No.: 09/526,674

(22) Filed: Mar. 16, 2000

(51) Int. Cl.[7] ..... B65D 85/00
(52) U.S. Cl. ..... 206/15.2; 206/363
(58) Field of Search ..... 206/15.2, 15.3, 206/361, 363, 364, 804; 215/227, 228, 231, DIG. 3, 202; 422/102

(56) References Cited

U.S. PATENT DOCUMENTS 555,708 * 3/1896 Reyer ..... 215/202
1,459,831 * 6/1923 Jones ..... 215/227
2,857,068 * 10/1958 Kraepelin ..... 215/231
4,632,240 * 12/1986 Gonclaves ..... 206/15.2
4,682,701 * 7/1987 Katz ..... 215/230
4,903,708 * 2/1990 Saint-Amand ..... 206/363
4,952,204 * 8/1990 Korteweg ..... 206/363
5,096,062 * 3/1992 Burkardt et al. ..... 206/361
6,089,391 * 7/2000 Abelbeck et al. ..... 215/228

* cited by examiner

*Primary Examiner*—Jim Foster

(57) ABSTRACT

A method of manufacturing a swab storage unit, that has an automatic swab extraction and retention structure and a methods of extracting a swab and manufacturing the unit. In one embodiment, the unit includes: (1) a container adapted to receive at least one swab having a fiber-tipped head and maintain the head proximate an opening thereof and (2) a cap, adapted to mate with and cover the opening, that has barbs coupled thereto to engage fibers of the fiber-tipped head and exert an extraction force to withdraw the swab from within the container as the cap is separated therefrom.

18 Claims, 2 Drawing Sheets

COTTON SWAB STORAGE UNIT HAVING AUTOMATIC SWAB EXTRACTION AND RETENTION STRUCTURE AND METHOD OF MANUFACTURE THEREOF

TECHNICAL FIELD OF THE INVENTION

The present invention is directed, in general, to portable storage units and, more specifically, to a cotton swab storage unit having an automatic swab extraction and retention structure and a method of manufacturing the same.

BACKGROUND OF THE INVENTION

You are in the sales business. This means that you have spent and will continue to spend a substantial amount of your time away from home shuttling between airports and office buildings. Nights are spent at local hotels or motels in the city where you end the day. You have learned to live out of a small suitcase and garment bag. You have searched for and purchased luggage that allows for the maximum degree of organization of the essentials needed to live on the road. Everything has its place and everything is in its place.

One benefit of your lifestyle is that you do get to spend weekends at home with your family. Your home life is kept as normal as possible and you spend as much time with your children as you can. In fact you are one of the assistant coaches for your son's baseball team. Last weekend they were practicing sliding into second base, and you were asked to demonstrate.

Now you have a nasty abrasion on your leg and your physician has prescribed a liquid antibiotic to be applied twice a day with a cotton swab. That means that you need to pack cotton swabs for your travels next week. Your organizational system for life on the road does not envision carrying cotton swabs.

What is the best way for a traveler to carry cotton swabs? Of course, he or she could grab a handful and toss them into the same case that houses his or her shaving or makeup kit, as the case may be. When time comes to use one, however, it has to be fished out of the bottom of the kit. The swab's fiber-tip has, more than likely, become contaminated from a leaky shampoo container, from debris that has accumulated in the bottom of the case or from the mere act of touching it. It certainly is not a satisfactory, much less a sanitary, way to carry a useful supply of swabs. Another solution is to grab a sandwich bag from the kitchen and toss in a few swabs, but they still become entangled with each other and difficult to extract when needed. Another prior art solution is to use an old medicine container. This, however, is a less than satisfactory solution, even if an appropriately sized one can be found, because the swabs may become wedged in the container and therefore difficult to remove.

Similar storage and transportation problems for handling fiber-tipped swabs in small quantities are encountered when small first aid kits or medical kits are being assembled. How can the swabs be maintained in a fresh usable condition without being contaminated by the surrounding environment?

Accordingly, what is needed in the art is a container that can store a small quantity of fiber-tipped swabs that is convenient to use and does not require undue effort to extract a swab therefrom.

SUMMARY OF THE INVENTION

To address the above-discussed deficiencies of the prior art, the present invention provides a cotton swab storage unit that has an automatic swab extraction and retention structure and a methods of extracting a swab and manufacturing the unit. In one embodiment, the unit includes: (1) a container adapted to receive at least one swab having a fiber-tipped head and maintain the head proximate an opening thereof and (2) a cap, adapted to mate with and cover the opening, that has barbs coupled thereto to engage fibers of the fiber-tipped head and exert an extraction force to withdraw the swab from within the container as the cap is separated therefrom.

The present invention therefore introduces a container having a novel structure whereby swabs are removed as the cap is removed, thereby advantageously presenting the swabs for use and increasing a likelihood that they remain sanitary.

In one embodiment of the present invention, the cap has a sleeve defining a receptacle in the cap so that the container maintains the fiber-tipped head of the swab within the receptacle and constrains any rotation of the swab as it is being withdrawn by the cap. In another embodiment of the invention, the barbs are located on at least one finger that extends from an inner surface of the cap. In still another embodiment of the invention, the container is elongated to maintain the swab parallel to the major dimension of the container. This is a beneficial embodiment, in that the swabs do not splay out after removal, thereby rendering them difficult to reinsert into the container.

One embodiment of the present invention provides for the container to be composed of a transparent plastic in order to allow the swab to be seen within the container. In yet another embodiment of the invention, the cap is composed of plastic. A particularly advantageous embodiment of the invention, provides for the container to have a bent channel proximate the opening and the cap to have a protrusion that mates with the channel. This is an advantageous feature of the invention to assist in retaining the cap in a closed position with respect to the container.

The invention also provide for a method of extracting a swab. The method, in one embodiment, calls for grasping a container containing at least one swab having a fiber-tipped head, where the container maintains the head proximate an opening thereof, and separating a cap from the container. Because the cap has barbs coupled thereto to engage fibers of the fiber-tipped head removing the cap thereby exerts an extraction force to withdraw the swab from within the container. The invention also provides for other embodiments of methods of extracting a swab from a container.

The invention also introduces methods of manufacturing a swab storage unit. One embodiment of a method of manufacturing a swab storage unit calls for forming a container adapted to receive at least one swab having a fiber-tipped head, the container configured to maintain the head proximate an opening thereof. The method also calls for forming a cap adapted to mate with and cover the opening, the cap having barbs coupled thereto to engage fibers of the fiber-tipped head and thereby exert an extraction force to withdraw the swab from within the container as the cap is separated therefrom. The invention also provides for other embodiments of methods to manufacture a swab storage unit, which methods are applicable to any type of swab storage unit that is described herein.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
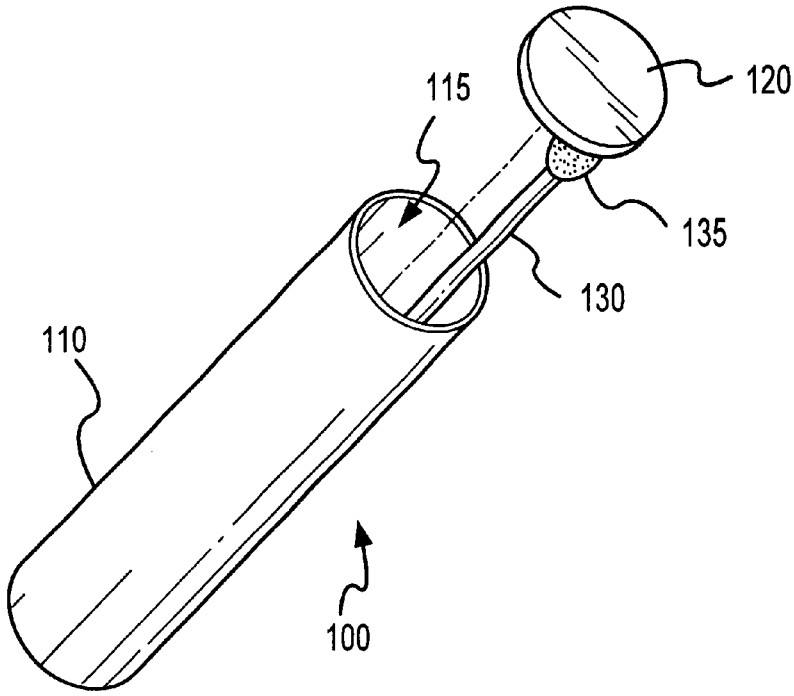
FIG. 1 illustrates an isometric view of one embodiment of a cotton swab storage unit constructed in accordance with the present invention.

Referring initially to FIG. 1, illustrated is an isometric view of one embodiment of a cotton swab storage unit 100 constructed in accordance with the present invention. The storage unit 100 includes a container 110 with an opening 115 and a cap 120 that mates with the container 110 to cover the opening 115. Extending from inside the illustrated container 110 is a swab 130 with a fiber-tipped head 135. The container 110 is adapted to maintain the fiber-tipped head 135 of the swab 130 proximate to the opening 115. Although the invention provides for the container 110 to be adapted to receive at least one swab 130 with a fiber-tipped head 135, those skilled in the pertinent art will recognize that a container 110 adapted to receive a number of swabs 130 is within the intended scope of the invention.

Those skilled in the pertinent art will also understand that, although the illustrated container 110 has a cylindrical shape, any shape of container 110 (such as, without being limited to, a square or a multi-sided container) adapted to receive at least one swab is within the intended scope of the present invention. In certain situations a shape other than a cylindrical shape may be advantageous. For example, in may be easier for a logo or monogram to be embossed on the flat surface provided by a container 110 with a square or rectangular cross-section than on a round container 110. A container 110 that has a square or rectangular cross section will also permit the cotton swab storage unit 100 to be more easily accommodated in a personal make-up or shaving kit such as, for example, by located a clip or attachment device on the storage unit 100.

One embodiment of the invention provides for the container 110 to be elongated. Such an elongated shape maintains the swab 130 parallel to the major dimension of the container 110. This is a beneficial embodiment to keep the swabs 130 from becoming intertwined within the storage unit 100 and making them difficult to remove without scattering swabs 130 all over the place.

Figure 2:
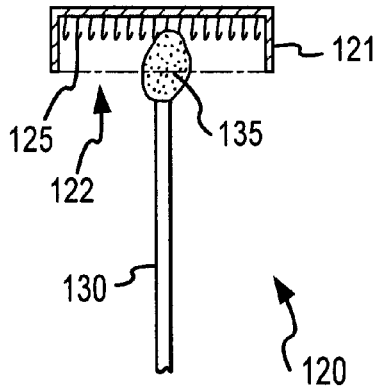
FIG. 2 illustrates a cross-sectional view of one embodiment of a cap constructed in accordance with the present invention that provides an automatic swab extraction and retention function.

Turning now to FIG. 2, illustrated is a cross-sectional view of one embodiment of the cap 120 that provides an automatic swab 130 extraction and retention function. The illustrated embodiment of a cap 120 has a number of barbs 125 coupled thereto that engage the fiber in the fiber-tipped head 135 of the swab 130. The barbs 125 engage the fibers that make up the head 135 with a grip sufficient to exert an extraction force to withdraw the swab 130 from within the container 110 as the cap 120 is separated therefrom.

Also illustrated in FIG. 2 is a particularly advantageous embodiment of the present invention. This embodiment provides for the cap 120 to have a sleeve 121 defining a receptacle 122 in the cap 120. This feature assists in the container 110 maintaining the fiber-tipped head 135 of the swab 135 within the receptacle 122. This restricts rotation of the swab 130 as the swab 130 is being withdrawn from the container 110 as the cap 120 is removed and aids reinsertion of the swab 130 back into the container 110.

Figure 3A:
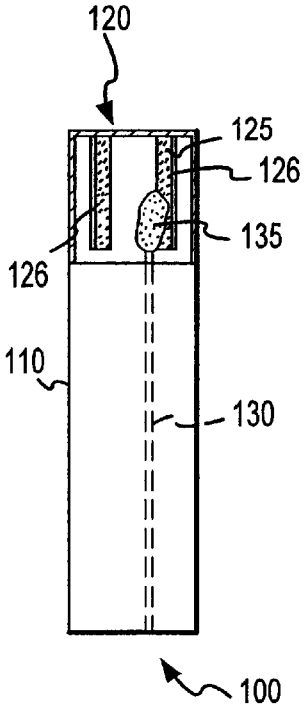
FIG. 3A illustrates a cross-sectional view of an embodiment of the storage unit where the cap has barbs located on at least one finger extending from an inner surface.
Figure 3B:
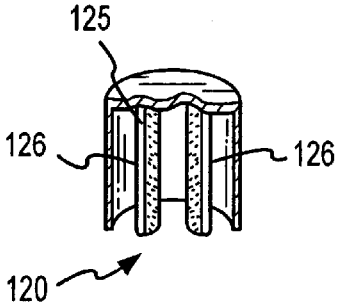
FIG. 3B illustrates an isometric cross-sectional view of the cap illustrated FIG. 3A.
Figure 3C:
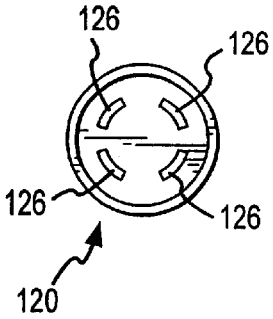
FIG. 3C illustrates a planar bottom view of the cap illustrated in FIGS. 3A and 3B.

Turning to FIG. 3A, illustrated is a cross-sectional view of an embodiment of a storage unit 100 in which the cap 120 has barbs 125 located on at least one finger 126 extending from an inner surface of the cap 120. FIG. 3B is a cross-sectional isometric view of the cap 120 illustrated in FIG. 3A. FIG. 3C illustrates a bottom view of the cap 120 illustrated in FIGS. 3A and 3B. FIGS. 3A–3C will be used to explain a particularly advantageous embodiment of the invention.

This embodiment provides for the cap 120 to have at least one finger 126 extending from an inner surface. As illustrated in FIG. 3C, the cap 120 can have more than one finger 126 arranged to extend downward along the inside surface of the container 110. The fingers 126 can also be designed to assist in securing the cap 120 to the container 110. Barbs 125 are located on the fingers 126 (the barbs 125 can be the result of using a roughened plastic material) that sufficiently engage the fibers making up the head 135 of the swab 130 to withdraw the swab 130 from within the container 110. This can be done as the cap 120 is being separated from the container 110 or the cap 120 can be used to fish a swab 130 from the container 110 by inserting the finger 126 into the container 110 and snagging a swab 130 by its fiber-tipped head 135.

Although any material (such as precious or light metals or plastic) can be used to make the storage unit 100 and be within the intended scope of the present invention, a particularly advantageous embodiment of the present invention provides for the container 110 to be composed of a transparent plastic in order to allow the swab 130 to be seen within the container without removing the cap 120. In yet another embodiment of the invention, the cap is composed of plastic. Of course, those skilled in the pertinent art will recognize that plastic is a particularly attractive material to use in making the storage unit 100. Plastics are readily moldable and can be molded in various colors, either transparent, translucent or opaque, perhaps with various designs incorporated therein.

Figure 4:
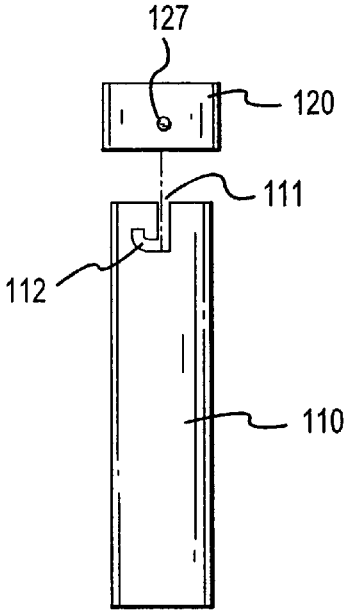
FIG. 4 illustrates a side elevational view of one embodiment of the present invention in which a device secures the cap to the container.

Turning to FIG. 4, illustrated is a side view of one embodiment of the invention showing a device to secure the cap 120 to the container 110. In the illustrated embodiment, the container 110 has a bent channel 111 proximate the opening. The cap 120 has a protrusion 127 thereon that engages with the channel 111 and hooks into a bend 112 in the channel to retain the cap 120 on the container 110. This embodiment, of course, is but one way in which the cap 120 can be secured to the container 110. Other features that could be incorporated in the invention to secure the cap 120 to the container include, without limitation, bayonet extensions from the inside edge of the cap 120 (similar to the finger 126 illustrated in FIG. 3), pressure fits, a threaded container with a threaded cap, as well as other devices now known or later discovered. Those skilled in the pertinent art will understand that any device used to secure the cap 120 to the container 110 will be within the intended scope of the present invention.

The present invention also provides a method of extracting a swab from a cotton swab storage unit and a method of manufacturing a cotton swab storage unit. The method of extracting a swab and the method of manufacturing a cotton swab storage unit is apparent from the foregoing detailed description and illustrations. Other extraction techniques and manufacturing methods and techniques, however, are within the scope of the intended invention.

Although the present invention has been described in detail, those skilled in the art should understand that they can make various changes, substitutions and alterations herein without departing from the spirit and scope of the invention in its broadest form.

What is claimed is:

1. A swab storage unit, comprising:

a container adapted to receive at least one swab having a fiber-tipped head and maintain said head proximate an opening thereof; and a cap, adapted to mate with and cover said opening, that has at least one finger extending from an inner surface of said cap with barbs located thereon to engage fibers of said fiber-tipped head and thereby exert an extraction force to withdraw said swab from within said container as said cap is separated therefrom.

2. The unit as recited in claim 1 wherein said cap has a sleeve that defines a receptacle therein, said container maintaining said head within said receptacle thereby to constrain a rotation of said swab as said cap withdraws said swab from within said container.

3. The unit as recited in claim 1 wherein said container is elongated and maintains said swab parallel to a major dimension thereof.

4. The unit as recited in claim 1 wherein said container is composed of a transparent plastic to allow said swab to be seen from without said container.

5. The unit as recited in claim 1 wherein said cap is composed of plastic.

6. The unit as recited in claim 1 wherein said container comprises a bent channel proximate said opening and said cap has a protrusion that mates with said channel to assist in retaining said cap in a closed position with respect to said container.

7. A method of extracting a swab, comprising:

grasping a container containing at least one swab having a fiber-tipped head, said container maintaining said head proximate an opening thereof; and separating a cap from said container, said cap having at least one finger extending from an inner surface of said cap with barbs located thereon to engage fibers of said fiber-tipped head and thereby exert an extraction force to withdraw said swab from within said container as said cap is separated therefrom.

8. The method as recited in claim 7 wherein said cap has a sleeve that defines a receptacle therein, said container maintaining said head within said receptacle thereby to constrain a rotation of said swab as said cap withdraws said swab from within said container.

9. The method as recited in claim 7 wherein said container is elongated and maintains said swab parallel to a major dimension thereof.

10. The method as recited in claim 7 wherein said container is composed of a transparent plastic to allow said swab to be seen from without said container.

11. The method as recited in claim 7 wherein said cap is composed of plastic.

12. The method as recited in claim 7 wherein said container comprises a bent channel proximate said opening and said cap has a protrusion that mates with said channel to assist in retaining said cap in a closed position with respect to said container.

13. A method of manufacturing a swab storage unit, comprising:

forming a container adapted to receive at least one swab having a fiber-tipped head, said container configured to maintain said head proximate an opening thereof; and forming cap adapted to mate with and cover said opening, said cap having at least one finger extending from an inner surface of said cap with barbs located thereon to engage fibers of said fiber-tipped head and thereby exert an extraction force to withdraw said swab within said container as said cap is separated therefrom.

14. The method as recited in claim 13 wherein said forming said cap comprises forming a sleeve that defines a receptacle in said cap, said container maintaining said head within said receptacle thereby to constrain a rotation of said swab as said cap withdraws said swab from within said container.

15. The method as recited in claim 13 wherein said container is elongated and maintains said swab parallel to a major dimension thereof.

16. The method as recited in claim 13 wherein said forming said container comprises forming said container of a transparent plastic to allow said swab to be seen from without said container.

17. The method as recited in claim 13 wherein said forming said cap comprises forming said cap of plastic.

18. The method as recited in claim 13 wherein said forming said container comprises forming a bent channel proximate said opening, said forming said cap comprising forming a protrusion on said cap that mates with said channel to assist in retaining said cap in a closed position with respect to said container.

* * * * *